US005119738A

United States Patent [19]

Snead

[11] Patent Number: 5,119,738

[45] Date of Patent: Jun. 9, 1992

[54] HOPPER CONSTRUCTION

[76] Inventor: Edwin deS. Snead, P.O. Box 529, Georgetown, Tex. 78627

[21] Appl. No.: 627,579

[22] Filed: Dec. 14, 1990

[51] Int. Cl.[5] ..... B61D 7/04

[52] U.S. Cl. ..... 105/250; 105/251; 105/247; 105/280

[58] Field of Search ..... 105/247, 250, 251, 280, 105/411, 419, 404

[56] References Cited

U.S. PATENT DOCUMENTS

| | | | |
|---|---|---|---|
| 2,821,433 | 1/1958 | Hamlet | 105/247 |
| 2,989,930 | 6/1961 | Flowers | 105/248 |
| 3,404,650 | 10/1968 | Miller et al. | 105/250 |
| 3,902,434 | 9/1975 | Barnard et al. | 105/250 |
| 4,250,814 | 2/1981 | Stark et al. | 105/280 |
| 4,925,356 | 5/1990 | Sneed et al. | 414/339 |

*Primary Examiner*—Robert J. Oberleitner
*Assistant Examiner*—Kevin D. Rutherford
*Attorney, Agent, or Firm*—Harrison & Egbert

[57] ABSTRACT

A hopper for a railroad car having a pair of side hopper walls, a pair of end hopper walls, a gate system positioned at a hopper discharge opening, and a crossmember affixed at one end to one of the side hopper walls and affixed at another end to another of the side hopper walls. This crossmember is positioned generally halfway between the end hopper walls. A first support bar is affixed to the side walls in an area between the crossmember and one of the end walls. A second support bar is affixed to the side walls in an area between the crossmember and the other of the end walls. The gate system is a pair of clamshell-type gates that are pivotable about axes parallel to the longitudinal axis of the hopper car. A strut is pivotally mounted to the crossmember and extends downwardly therefrom. This first strut is affixed at one end to one of the clamshell-type gates. A second strut is also pivotally mounted to the crossmember and extends downwardly so as to be affixed to the second clamshell-type gate. The first and second struts extend outwardly above the pivotal connection with the crossmember. The first and second struts define an acute angle therebetween. Another support bar is affixed to the hopper side walls directly beneath the crossmember and adjacent to the hopper discharge opening.

12 Claims, 3 Drawing Sheets

HOPPER CONSTRUCTION

TECHNICAL FIELD

The present invention relates to hoppers for railroad cars in general. More particularly, the present invention relates to the construction of hopper cars for the efficient transport of bulk commodities.

BACKGROUND ART

Rail transportation is generally recognized as being more economical than truck transportation for bulk commodities such as aggregates. Large quantities of such commodities can be moved by a small crew at low cost. However, rail transportation frequently loses out in competitive situations because of the cost of unloading, stockpiling, and delivering the commodity to the ultimate destination.

Even though large quantities of bulk material can be transported at low cost from one terminal to another, the burden is placed on the unloading facility to maintain the economics of this method of transportation for the purchaser of the commodity. Even if the unloading is slow, and the train is therefore delayed for a substantial period of time for the unloading to be accomplished, there is an added investment cost per ton handled for the use of the railroad equipment. One problem, in this regard, is that rail transportation is a twenty-four hour operation while many of the industries it serves operate only during daylight hours. Often a train makes good speed from origin to destination, only to be delayed several hours waiting to be unloaded. Each hour of delay adds to the transportation cost as much as an additional twenty-five to thirty miles of haul.

As an example of the efficiency of rail transport for bulk commodities, a train with a two-man crew pulling 1600 net tons at fifty-five miles per hours would be producing thirty-two times as many ton-miles per hour as a dump truck drive hauling twenty-five tons at fifty-five miles per hour.

Another problem affecting the efficiency of rail transportation for bulk commodities is that, under current methods, the quick unloading of a commodity train requires high capacity equipment and facilities which are idle most of the time. Such high-capacity equipment and facilities are expensive and add significantly to the investment cost per ton handled.

It is important for rail transportation of bulk commodities to offer ease of unloading and ease of transportation. This is particularly the case where aggregates and bulk material having a particle size ratio of over six are involved. (A particle size ratio of six means that the largest particles are no more than six times the size of the smallest particles.) Also, the amount of load that can be carried by the rail transportation system is a function of the center of gravity of the load. If the center of gravity of the load is too high, then less material can be carried. A high center of gravity will enhance the risk of derailing and/or toppling of hopper cars. Additionally, hopper cars that have relatively shallow walls and relatively small discharge openings will create difficulties when the material is desired to be discharged. With certain types of materials, the shallow walls will cause a "bridging" effect with the material within the hopper car. Thus, it becomes difficult to unload the hopper car when the hopper car reaches the destination site.

The following are some of the methods which are currently used for the unloading of bulk materials from trains.

Bottom dumping hopper cars are equipped with automatic doors that are opened automatically as the cars move over a pit, where the pit facility includes a feeder and a conveyor. Either a pit or an elevated trestle is required for this method, so that this method is ruled out at many locations. Obviously, the providing of a pit or trestle facility with associated conveyor systems is expensive.

Another method involves the use of rotary car dumpers; and these are commonly used for unloading coal at electric generating plants. Again, the equipment for unloading the cars is highly specialized and expensive.

Side dumping cars have been used for many years, but cannot be dumped on level ground. They require an elevated track on a built-up embankment for example that t he dumped material will flow over the side of the embankment and not flow back over the track.

Finally, backhoes or other unloading equipment are used to unload standard gondola cars. These methods are generally slow, promoting the delay problems mentioned above.

West German Patent Specification No. 24 51 518 describes a railway goods train with an automatic material unloader. This material unloader includes a conveyor belt located within the hopper cars to assist in the discharge of material. This system includes a conveyor belt that is located so as to create a high center of gravity for the hopper car. In particular, the conveyor belt has a return run mounted above the car platform that has troughing idlers mounted in a conventional fashion and spaced significantly from the return idlers. Additionally, this German Specification shows a hopper car having relatively shallow walls and small discharge openings. This is suitable for the transportation of sand or bulk materials having a particle size ratio of six or less. However, such a configuration of hopper car is not appropriate for the transportation of aggregates or material having large particle size ratios.

To take maximum advantage of the efficiencies of rail transportation for aggregate materials, a special type of train is needed to deliver bulk commodities on any track, at any time of the day or night, with no labor required other than the train crew. Such a train would make optimum use of labor while providing incentive wages for the crew, and thereby reduce overall labor costs.

A self-unloading train which overcomes many of the above-discussed disadvantages of rail transportation for aggregate materials may be a "unit train" consisting of a plurality of hopper cars and a trailer car, the unit train to be pulled by a conventional locomotive. Each of the hopper cars may include several hoppers having bottom discharge openings and associated gates for discharging onto an endless belt conveyor which runs the entire length of the train. These hopper cars would have walls that were inclined at relatively steep angles and have relatively large bottom discharge openings. The trailer car would include a transfer conveyor which receives the material from the train conveyor, and is movable on the trailer car to transfer the material to a selected point relative to the train.

With the unit train moving along a straight section of track, the material may be deposited in a window along the track by the transfer conveyor. Alternatively, the unit train may be unloaded while stationary, with the transfer conveyor discharging onto a portable stacking conveyor, for example, which will enable the deposit of the material in piles thirty feet high, at least forty feet away from the track, for example.

A significant development in the furtherance of this "unit train" concept occurred with the invention of U.S. Pat. No. 4,925,356, issuing on May 15, 1990 to the present inventor and to William B. Snead. U.S. Pat. No. 4,925,356 disclosed a self-unloading train for the transfer of bulk commodities that comprises a plurality of hopper cars, a train conveyor, and a gating system. The plurality of hopper cars are coupled together to form a train. Each hopper car has at least one hopper having walls inclined at shallow angles to the vertical and a bottom discharge opening having a width at least fifty percent of the distance between the wheels of the hopper cars. The train conveyor is an endless belt supported on the cars and underlying each of the hopper discharge openings. This endless belt receives the material discharge from the hopper discharge opening. The train conveyor extends for the length of the plurality of hopper cars. The train conveyor has a width that is substantially greater than the width of the discharge openings. The gating systems are operable selectively so as to discharge material from the hoppers onto the train conveyor. In particular, these gating systems are made up of clamshell-type gates that are pivoted about an axis parallel to the train conveyor. These clamshell-type gates assist in controlling the flow of material onto the train conveyor.

After experimentation with the physical embodiment of the concept of U.S. Pat. No. 4,925,356, presently produced under the trademark "DUMP TRAIN", it was found that the clamshell-type gates as used on the DUMP TRAIN were the perfect solution to the passing of bulk commodities from the hopper onto the conveyor belt. Unfortunately, these clamshell-type gates, and the associated hopper structure, were particularly heavy. Under the rules and regulations which affect railroad operations, the amount of cargo that a particular hopper car can carry is limited, in part, by the weight of the hopper car itself. As the weight of the hopper car is reduced, without sacrificing volume, a greater amount of cargo can be carried. As such, it was felt important to reduce the weight of the clamshell-type gates without sacrificing structural integrity, volume, or functionality.

It is an object of the present invention to provide a hopper construction that increases the structural integrity of the hopper.

It is another object of the present invention to provide a hopper construction that allows for clamshell-type gates to be of reduced weight.

It is a further object of the present invention to provide a hopper construction in which the problem of material briding within the hopper is reduced.

These and other objects and advantages of the present invention will become apparent from a reading of the attached specification and appended claims.

SUMMARY OF THE INVENTION

The present invention is a hopper for a railroad car that comprises a pair of side hopper walls, a pair of end hopper walls, a gating system positioned at the hopper discharge opening and the bottom of the hopper walls, and a crossmember that is connected to each of the side hopper walls and extends therebetween. The side hopper walls and the end hopper walls are joined so as to form a generally rectangular configuration. These walls define the hopper discharge opening at the bottom of these hopper walls. The gating system is positioned at the hopper discharge opening. The gating system is operable selectively so as to allow for the discharge of material from within the hopper walls.

The present invention includes a first support bar that is affixed at one end to one of the side hopper walls and is affixed at the other end to another of the side hopper walls. This first support bar is positioned between the crossmember and one of the end walls. A second support bar is also affixed to each of the side hopper walls in the manner of the first support bar. The second support bar is positioned between the crossmember and one of the end walls. Each of the first and second support bars is positioned adjacent to the hopper discharge opening. A third support bar is also affixed to each of the hopper side walls adjacent to the hopper discharge opening and below the crossmember.

The gating system of the present invention has a first clamshell-type gate pivotally about an axis parallel to the longitudinal axis of the hopper car. A second clamshell-type gate is also rotatably mounted along an opposite side of the hopper walls. This second clamshell-type gate is in coordination with the first gate. Each of the first and second gates are movable between a material retention position and a material discharge position.

The present invention has a first strut that is pivotally mounted to the crossmember. The strut extends downwardly from the crossmember and is affixed at one end to the first clamshell-type gate. A second strut is also pivotally mounted to the crossmember. The second strut similarly extends downwardly from the crossmember and is affixed at one end to the second clamshell-type gate. The first and second struts are arranged such that an acute angle extends therebetween. Each of the first and second struts also includes a portion extending above the point of pivotal connection with the crossmember.

The crossmember specifically comprises a first bridging bar that is affixed to each of the side hopper walls and a second bridging bar that is parallel to and aligned with the first bridging bar. The second bridging bar is also affixed to each of the side hopper walls. The first and second struts are pivotally mounted between the first and second bridging bars. The crossmember also includes a first cross pin that extends between the first bridging bar and the second bridging bar. This first cross pin receives the first strut in rotatable relationship. A second cross pin also extends between the first bridging bar and the second bridging bar. The second cross pin receives the second strut.

The present invention also includes a hydraulic control system that is connected to the first and second clamshell-type gates. The hydraulic control system serves to actuate the movement of the first and second gates between the material retention position and the material discharge position.

Also, the present invention includes a conveyor system that is supported in catenary fashion underlying the hopper discharge opening. This conveyor system serves to transfer material from the hopper discharge opening. The gates open parallel to this conveyor system.

DETAILED DESCRIPTION OF THE INVENTION

Figure 1:
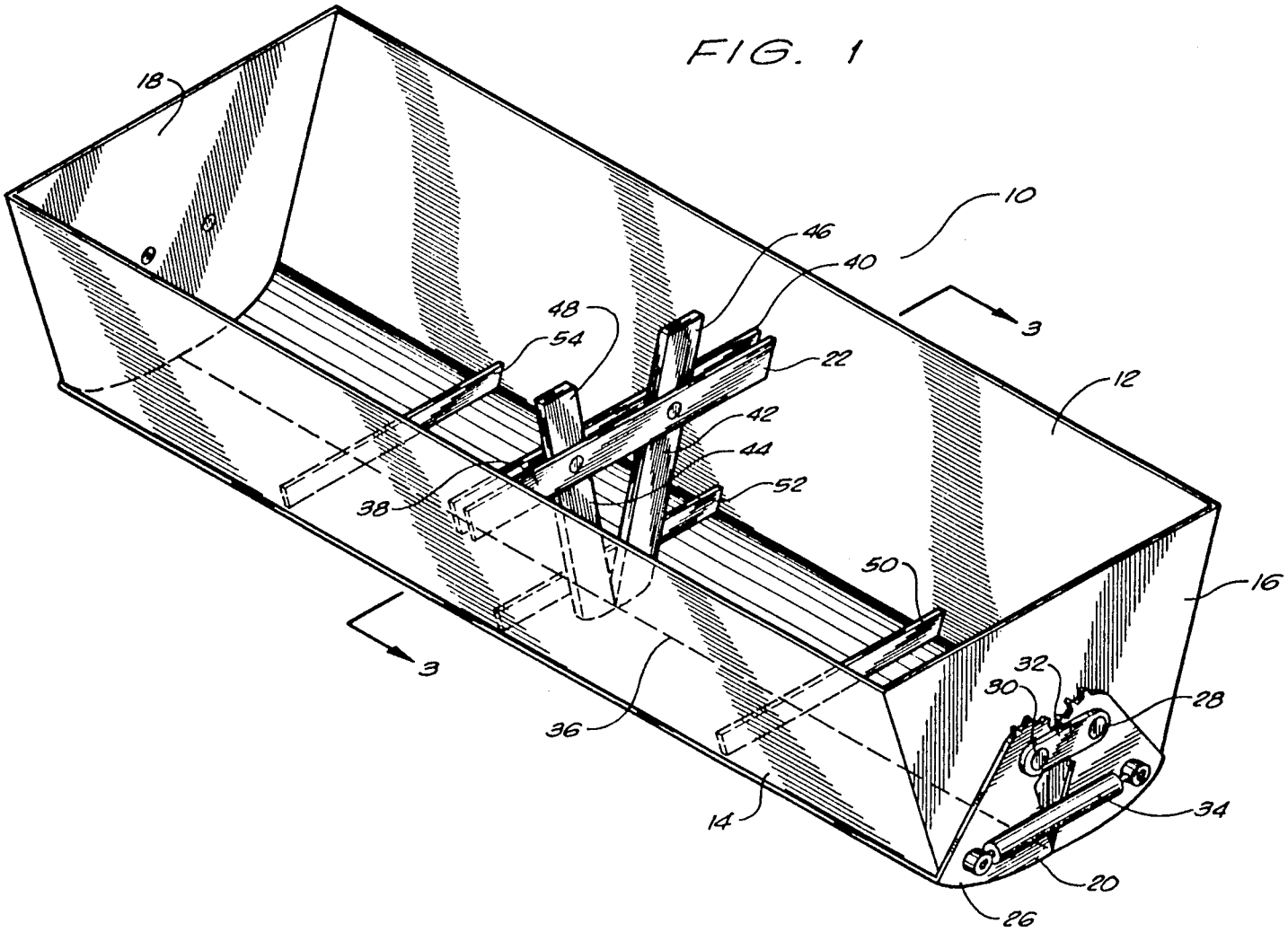
FIG. 1 is a perspective view showing the hopper construction in accordance with the preferred embodiment of the present invention.

Referring to FIG. 1, there is shown at 10 the improved hopper construction in accordance with the preferred embodiment of the present invention. Hopper construction 10 comprises a pair of side hopper walls 12 and 14, a pair of end hopper walls 16 and 18, a gate system 20, and a crossmember 22. The side hopper walls 12 and 14 are joined to the end hopper walls 16 and 18 so as to form a generally rectangular configuration. The side hopper walls 12 and 14 and the end hopper walls 16 and 18 define a hopper discharge opening at the bottom of these hopper walls. The gate system 20 is positioned at the hopper discharge opening. This gate system 20 operates selectively so as to allow for the discharge of material from the area within the hopper walls 12, 14, 16 and 18. Crossmember 22 is affixed at one end to the side hopper wall 12 and is affixed at the other end to the side hopper wall 14. The crossmember 22 serves to maintain a certain degree of structural integrity with the side hopper walls 12 and 14.

Side hopper walls 12 and 14 are generally rectangular steel panels. The side hopper walls 12 and 14 are inclined at an angle of greater than sixty-five (65°) from the horizontal. This steep angle of the hopper walls eliminates the "bridging" effect, to a certain extent, with the material within the hopper car. As was stated previously, certain types of material tend to bridge when the hopper cars are constructed with relatively shallow walls and relatively small discharge openings. This is particularly important when the material being hauled accumulates an appreciable amount of moisture. Such materials include coal, crushed limestone, or sand. By using the steep walls illustrated in FIG. 1 for the side walls 12 and 14 and for the end walls 16 and 18, the problems associated with the bridging of materials are substantially reduced. The steep angle of the hopper walls 12, 14, 16 and 18 allow for the free flow of such material and for expeditious unloading of materials from the interior of hopper construction 10.

The end hopper walls 16 and 18 are joined to the side hopper walls 12 and 14. These end hopper walls 16 and 18 are vertical.

The gate system 20 includes a first clamshell-type gate 24 and a second clamshell-type gate end 26. Each of these first and second clamshell-type gates ends are pivotable about an axis 28 and an axis 30, respectively, which is parallel to the longitudinal axis of the hopper construction 10. The second clamshell-type gate end 26 is rotatably mounted along an opposite side of the hopper walls relative to the first clamshell-type gate end 24. The second clamshell-type gate 26 operates in coordination with the first clamshell-type gate 24. Each of these clamshell-type gate ends 24 and 26 is movable between a material retention position and a material discharge position. The axes 28 and 30 are joined together by a bracket member 32 and forced to operate symmetrically by the meshing of the gear teeth on gate ends 24 and 26. The clamshell-type gate ends 24 and 26 are operable by the actuation of hydraulic mechanism 34. Hydraulic mechanism 34 is connected at each end to the gates. The clamshell-type gates extend for the length of the hopper construction 10 and serve to cover the hopper discharge opening when the gates ar in their closed position. The hydraulic mechanism 34 is a double-action piston-and-cylinder arrangement which is connected to the first clamshell-type gate and the second clamshell-type gate for the purpose of actuating the movement of these gates between the material retention position and the material discharge position. When actuated, the hydraulic mechanism 34 will cause the gates 24 and 26 to separate at the intersection 36. A similar construction of the gates and hydraulic mechanism is arranged on the end wall 18 of hopper construction 10.

Figure 2:
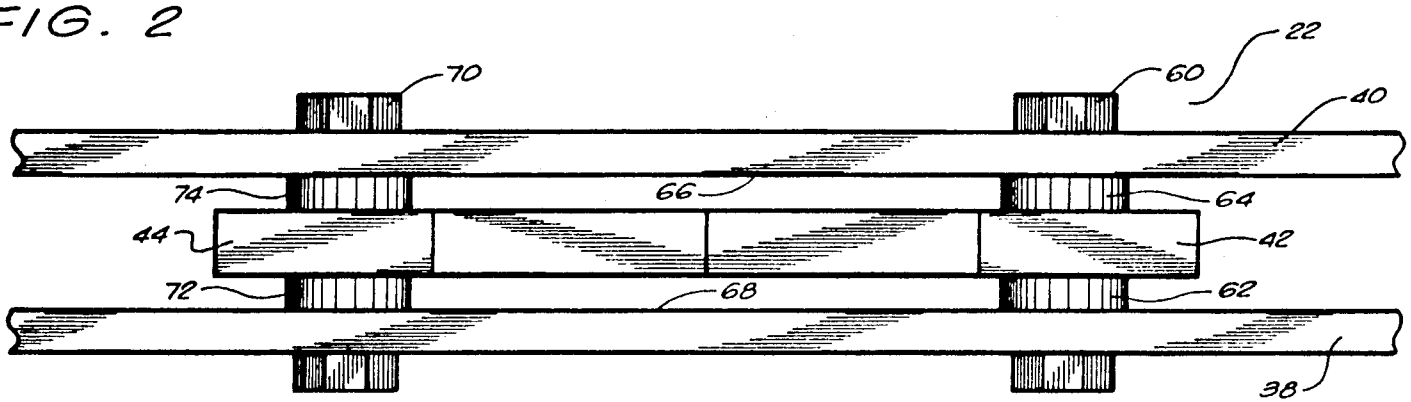
FIG. 2 is an isolated view showing the interconnection of the bridging bars, the cross pins, and the struts.

The crossmember 22 comprises a first bridging bar 38 and a second bridging bar 40 (better illustrated in conjunction with FIG. 2). A first strut 42 is pivotally mounted to the crossmember 22. This first strut 42 is a substantial steel member that extends downwardly from the crossmember 22 and is affixed to the top surface of the first clamshell-type gate 24. A second strut 44 is also pivotally mounted to the crossmember 22. The second strut extends downwardly from the crossmember 22 and is affixed at one end to the upper surface of clamshell-type gate 26. As can be seen in FIG. 1, the struts 42 and 44 form an acute angle therebetween. When the clamshell-type gates 24 and 26 are opened, the struts 42 and 44 exhibit a scissor-type action in which the bottom portion of the struts 42 and 44 will move away from each other. Each of the struts 42 and 44 pivot relative to the crossmember 22. Strut 42 includes an extended portion 46 which extends outwardly above the crossmember 22. Similarly, the second strut 44 includes an extended portion 48 that extends outwardly above the crossmember 22.

Another feature of the present invention is the inclusion of support bars 50, 52, and 54. The first support bar 50 is affixed at one end to the side hopper wall 12. This first support bar 50 is also connected, at the other end, to the other side hopper wall 14. The first support bar is positioned generally adjacent to the hopper discharge opening and is located between the end hopper wall 16 and the crossmember 22.

The second support bar 54 is attached in parallel to the first support bar 50. The second support bar 54 has one end attached to side hopper wall 12 and the other end attached to side hopper wall 14. The second support bar 54 is positioned adjacent to the hopper discharge opening and is located between the crossmember 22 and the end hopper wall 18.

A third support bar 52 is also affixed in parallel to the first support bar 50 and the second support bar 54. The third support bar 52 is affixed at one end to the side hopper wall 12 and at the other end to the side hopper wall 14. This third support bar 52 i positioned adjacent to the hopper discharge opening 22 and is located generally beneath the crossmember 22. Each of the support bars 50, 52 and 54 add to the structural integrity of the hopper construction 10.

Referring to FIG. 2, there is shown a detailed view of the configuration of the crossmember 22. As can be seen, the crossmember 22 includes a first bridging bar 38 and a second bridging bar 40. Each of the bridging bars 38 and 40 is affixed, at the ends, to the side walls 12 and 14 of the hopper construction 10. A first cross pin 60 extends through the bridging bars 38 and 40. Cross pin 60 serves to receive the first strut 42. A pair of washers 62 and 64 are interposed between the sides of the strut 42 and the inner walls 66 and 68 of bridging bars 38 and 40. In the configuration illustrated in FIG. 2, the strut 42 is free to rotate about the cross pin 60 relative to the fixed bridging bars 38 and 40. A second cross pin 70 also extends between the first bridging bar 38 and the second bridging bar 40. The second cross pin 70 receives &he second strut 44. The second strut 44 is free to rotate about the axis of the cross pin 70. Washers 72 and 74 are interposed between the strut 44 and the inner walls 66 and 68 of the bridging bars 38 and 40.

Figure 3:
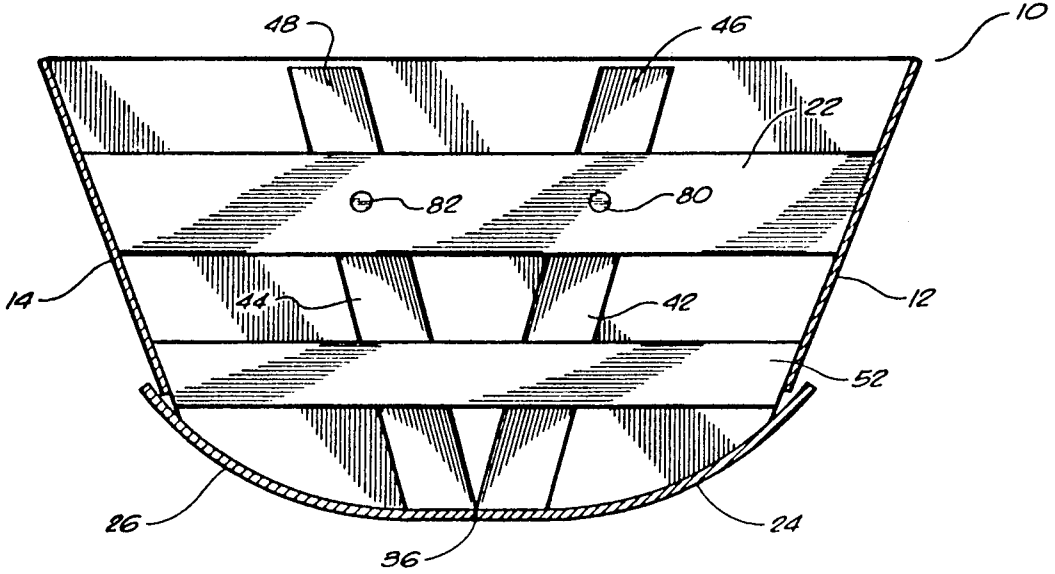
FIG. 3 is a cross-sectional view taken across lines 3—3 of FIG. 1.

FIG. 3 is a cross-sectional view showing the arrangement of the struts 42 and 44 within the hopper construction 10 of the present invention. Initially, it could be seen that the struts 42 and 44 are pivotally connected at 80 and 82, respectively, to the crossmember 22. The third support bar 52 is affixed to the side walls 12 and 14 adjacent to the hopper discharge opening. The strut 42 extends upwardly above the crossmember 22. Also, the second strut 44 extends above the crossmember 22. These outwardly extending portions 46 and 48 provide a scissor-like action during the movement of the clamshell-type gates 24 and 26. Strut 42 is affixed to the top surface of clamshell-type gate 24. Strut 44 is also affixed to the top surface of the second clamshell-type gate 26.

In FIG. 3, it can be seen that the clamshell-type gates 24 and 26 are closed so as to intersect at point 36. In this "material retention position" an material on the interior of hopper construction 10 is retained therein. When the hydraulics of the system are actuated, the first and second clamshell-type gates will move in a pivotal fashion with respect to pivot points 80 and 82. As such, the struts 42 and 44, which carry the clamshell-type gates 24 and 26 will rotate about pivot points 80 and 82, respectively. Eventually, the first clamshell-type gate 24 will be arranged about the exterior of side wall 12. The second clamshell-type gate 26 will be arranged close to the exterior wall of side wall 14. This will be the material discharge position in which any material contained within hopper construction 10 will pass through hopper discharge opening onto an underlying surface. It should be noted that the struts 42 and 44, along with their respective extensions 46 and 48, act in a scissor-like manner. As such, these struts 42 and 44 act to cut through the material contained within the hopper construction 10. Thus, this construction assists in the breakup of bridged materials. This arrangement further assists in the ability to discharge material through the hopper discharge opening.

One of the principal advantages of the present invention is the elimination of much of the weight from the clamshell-type gates 24 and 26. In the past, the clamshell-type gates 24 and 26 were required to be of relatively thick steel. Such thick steel was necessary so as to retain the structural integrity of the clamshell-type gates when the hopper construction 10 is loaded with material. Also, the hopper walls 12 and 14 required relatively thick steel so as to prevent distortion of the walls during loading. After experimentation, it was found that the hopper construction of the present invention eliminated greatly the need for the great thickness of the clamshell-type gates. Much of the weight load is supported by the use of the struts 42 and 44 and the crossmember 22. Similarly, the integrity of the hopper walls 12 and 14 is enhanced by the use of the support bars 50, 52 and 54. By the use of the present invention, the structural dynamics of the hopper construction 10 are greatly improved. A large amount of the weight of the proper construction 10 is eliminated. As such, the hopper construction 10 is able to carry a correspondingly greater amount of cargo. Additionally, the scissor-like action of the struts 42 and 44 further assist in the free flowing discharge of material from within the hopper construction.

Figure 4:
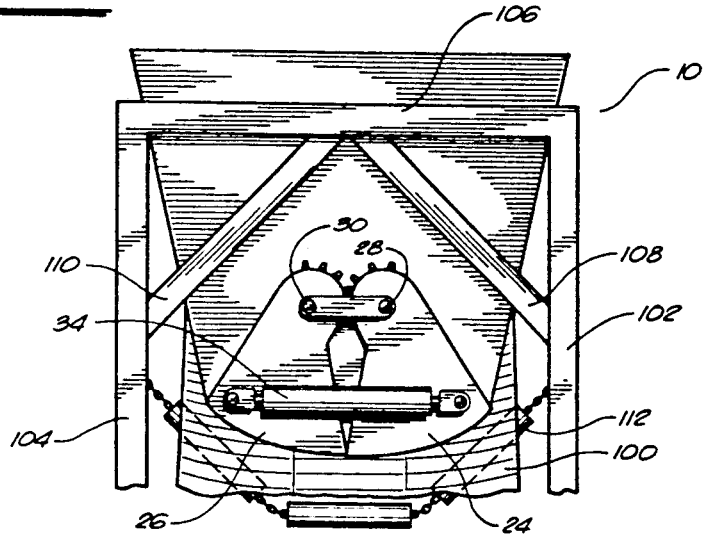
FIG. 4 is an end view of the hopper construction of the present invention as used in combination with a conveyor scheme.

FIG. 4 shows the configuration of the hopper construction 10 as used in combination with an underlying conveyor 100. As such, it can be seen that the present invention can be used in combination with a self-unloading train, of the type as identified with the trademark "DUMP TRAIN", and as specifically described in U.S. Patent No. 4,925,356. In this configuration, it can be seen that the hopper construction 10 is supported by vertical structural members 102 and 104. A structural crossmember 106 extends between the vertical structural members 102 and 104. Angle bars 108 and 110 serve to distribute the dynamic side load of the hopper 10 and its associated contents. The hopper 10 is fastened to these exterior structural members above the conveyor belt 100. Conveyor belt 100 is a continuous conveyor belt that is supported in a catenary fashion beneath the hopper discharge opening of the hopper construction 10. It can be seen that the clamshell-type gates 24 and 26 are positioned over the hopper discharge opening and above the conveyor 100. Hydraulic mechanism 34 can be actuated by a suitable hydraulic control system so as to open the clamshell-type gates 24 and 26 about their pivot axes 28 and 30. When the clamshell-type gates 24 and 26 are opened, any material contained within the hopper construction 10 is discharged onto the conveyor belt 100. The conveyor belt 100 can be used to transport the material to a location distal the hopper construction 10. It can be seen that the conveyor belt 100 is supported on idler 112 in a catenary fashion. Idler 112 is connected to the structural members 102 and 104 in a proper position so as to support the conveyor in the desired manner.

Figure 5:
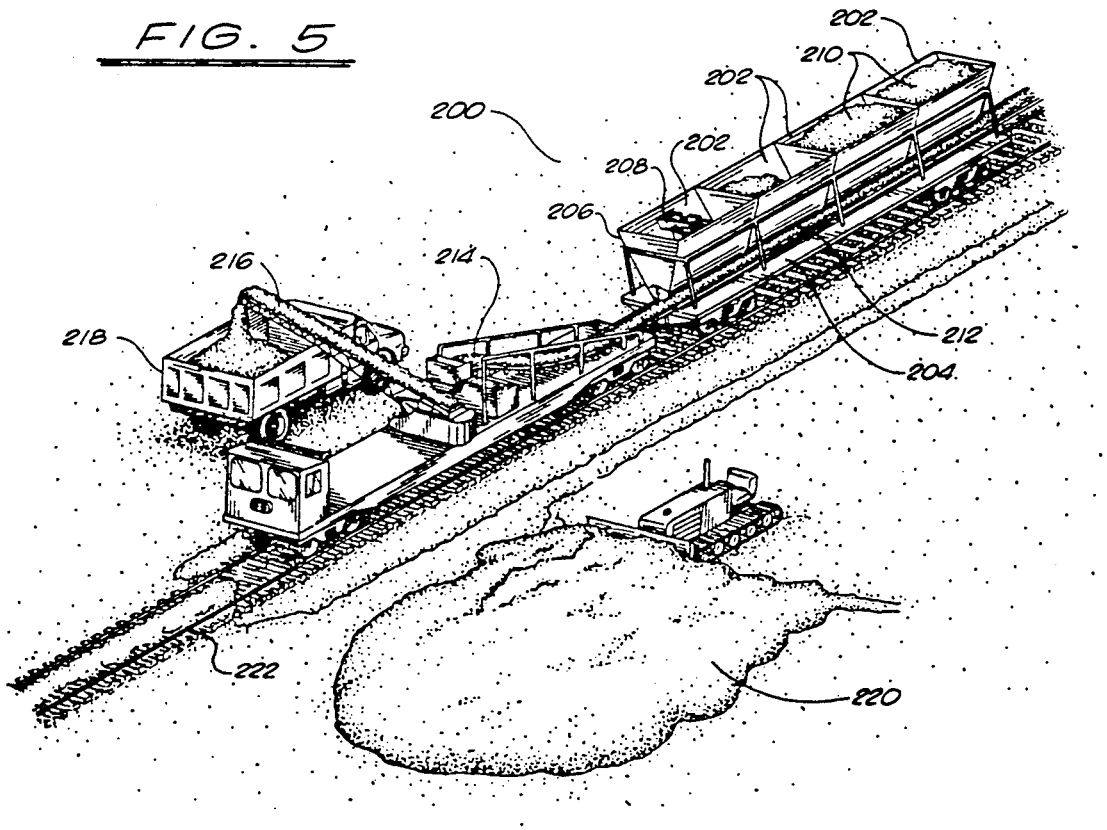
FIG. 5 is a illustration showing the operation of the hopper construction of the present invention in combination with a self-unloading train.

FIG. 5 shows the operation of the present invention in combination with a self-unloading train. The system 200 is shown as having a plurality of hoppers 202 arranged on a railroad car 204. It can be seen that the first hopper 206 is generally empty and includes a crossmember 208 for the purpose of maintaining the structural integrity of the hopper 202 in accordance with the present invention. The remaining hoppers 202 are loaded with aggregate material. When the gates of these hoppers 202 are emptied sequentially, the aggregate material 210 is discharged onto the continuous conveyor 212. The continuous conveyor 212 transports the aggregate material from the hoppers 202 to a location exterior of the railroad car 204. The material is then delivered to a lift conveyor 214 and deposited onto a transfer conveyor 206 and then into a truck 218. Alternatively, the material can be deposited into a pile 220 to the side of the railroad track 222. In essence, FIG. 5 shows the operation of the hopper construction of the present invention as used in combination with a self-unloading train. The configuration illustrated in FIG. 5 is a cost-effective and expedient way of depositing material from the hoppers 202 to an area exterior of the railroad car 204.

The present invention offers significant advantages over prior hopper construction. As stated previously, current U.S. railroad laws limit the amount of weight that can be carried on the railroad tracks. As such, it is ultimately desirable to minimize the weight of the railroad car while maximizing the weight of the cargo contained within the railroad car. Prior clamshell-type gate systems have added considerable weight and material cost to each of the railroad cars. By the construction of the present invention, this weight is dramatically reduced. As such, each of the railroad cars is better able to carry a correspondingly greater amount of cargo. Furthermore, the scissor-like action of the struts used for the present invention is better able to break up bridged materials and further adds in the flow of materials through the hopper discharge opening.

The foregoing disclosure and description of the invention is illustrative and explanatory thereof, and various changes in the details of the illustrated apparatus may be made within the scope of the appended claims without departing from the true spirit of the invention. The present invention should only be limited by the following claims and their legal equivalents.

I claim:

1. A hopper for a railroad car comprising:

a pair of side hopper walls;

a pair of end hopper walls, said side hopper walls and said end hopper walls being joined so as to form a generally rectangular configuration, said side hopper walls and said end hopper walls defining a hopper discharge opening at a bottom of said hopper walls;

gate means positioned at said hopper discharge opening, said gate means operable selectively so as to allow the discharge of material from within said hopper walls, said gate means comprising:

a first clamshell-type gate pivotal about an axis parallel to a longitudinal axis of said hopper car, said first clamshell-type gate rotatably mounted along one of said hopper walls; and a second clamshell-type gate rotatably mounted along an opposite side of said hopper walls, said second clamshell-type gate in coordination with said first clamshell-type gate, said first and second clamshell-type gates movable between a material retention position and a material discharge position;

a crossmember affixed at one end to one of said side hopper walls, said crossmember affixed at another end to another of said side hopper walls, said crossmember comprising:

a first bridging bar affixed to each of said side hopper walls;

a second bridging bar parallel to and aligned with said first bridging bar, said second bridging bar affixed to each of said side hopper walls;

a first cross pin extending between said first bridging bar and said second bridging bar; and a second cross pin extending between said first bridging bar and said second bridging bar;

a first strut pivotally mounted to said crossmember, said first strut extending downwardly from said crossmember, said first strut affixed at one end to said first clamshell-type gate; and a second strut pivotally mounted to said crossmember, said second strut extending downwardly from said crossmember, said second strut affixed at one end to said second clamshell-type gate;

said first and second struts pivotally mounted between said first bridging bar and said second bridging bar, said first cross pin receiving said first strut, said second cross pin receiving said second strut.

2. The hopper of claim 1, said crossmember positioned generally halfway between said end hopper walls.

3. The hopper of claim 2, further comprising:

a first support bar affixed at one end to one of said side hopper walls, said first support affixed at another end to another of said side hopper walls, said first support bar positioned between said crossmember and one of said end walls; and a second support bar affixed at one end to one of said side hopper walls, said second support bar affixed at another end to another of said side hopper walls, said second support bar positioned between said crossmember and one of said end walls.

4. The hopper of claim 1, said first and second struts having an acute angle therebetween when said first and second clamshell-type gates are in said material retention position.

5. The hopper of claim 4, each of said first and second struts having a portion extending above the pivotal connection with said crossmember.

6. The hopper of claim 1, further comprising:

hydraulic control means connected to said first and second clamshell-type gates, said hydraulic control means for actuating the movement of said first and second clamshell-type gates between said material retention position and said material discharge position.

7. The hopper of claim 1, further comprising:

conveying means supported in catenary fashion underlying said hopper discharge opening, said conveying means for transferring material distal said hopper discharge opening, said gate means opening parallel to said conveying means.

8. The hopper of claim 1, said hopper walls inclined at an angle greater than sixty-five degrees from the horizontal.

9. A hopper for a railroad car comprising:

a pair of side hopper walls;

a pair of end hopper walls, said side hopper walls and said end hopper walls being joined so as to form a generally rectangular configuration, said side hopper walls and said end hopper walls defining a hopper discharge opening at a bottom of said hopper walls;

gate means positioned at said hopper discharge opening, said gate means operable selectively so as to allow the discharge of material from within said hopper walls, said gate means comprising:

a first clamshell-type gate pivotal about an an axis parallel to a longitudinal axis of said hopper car, said first clamshell-type gate rotatably mounted along one of said hopper walls; and a second clamshell-type gate rotatably mounted along an opposite side of said hopper walls, said second clamshell-type gate in coordination with said first clamshell-type gate, said first and second clamshell-type gates movable between a material retention position and a material discharge position;

a crossmember affixed at one end to one of said side hopper walls, said crossmember affixed at another end to another of said side hopper walls, a first strut pivotally mounted to said crossmember, said first strut extending downwardly from said crossmember, said first strut affixed at one end to said first clamshell-type gate;

a second strut pivotally mounted to said crossmember, said second strut extending downwardly from said crossmember, said second strut affixed at one end to said second clamshell-type gate; and a support bar affixed at one end to one of said side hopper walls and affixed at another end to another of said side hopper walls, said support bar positioned adjacent said hopper discharge opening below said crossmember.

10. An improved hopper for a self-unloading train, said hopper of the type having a pair of side hopper walls and a pair of end hopper walls joined together to form a generally rectangular configuration, said hopper walls defining a bottom discharge opening, and a pair of clamshell-type gates at said bottom discharge opening, said improvement comprising:

a crossmember affixed to and extending between said hopper walls;

a first strut pivotally mounted to said crossmember, said first strut affixed to one of said pair of clamshell-type gates;

a second strut pivotally mounted to said crossmember, said second strut affixed to another of said pair of clamshell-type gates;

a first support bar affixed at one end to one of said side hopper walls, said first support affixed at another end to another of said side hopper walls, said first support bar positioned between said crossmember and one of said end walls;

a second support bar affixed at one end to one of said side hopper walls, said second support bar affixed at another end to another of said side hopper walls, said second support bar positioned between said crossmember and one of said end walls; and a third support bar affixed at one end to one of said side hopper walls and affixed at another end to another of said side hopper walls, said third support bar positioned adjacent said hopper discharge opening below said crossmember.

11. The improvement of claim 10, said first and second strut having an acute angle therebetween, each of said first and second struts having a portion extending above the pivotal mounting with said crossmember.

12. An improved hopper for a self-unloading train, said hopper of the type having a pair of side hopper walls and a pair of end hopper walls joined together to form a generally rectangular configuration, said hopper walls defining a bottom discharge opening, and a pair of clamshell-type gates at said bottom discharge opening, said improvement comprising:

a crossmember affixed to and extending between said hopper walls;

a first strut pivotally mounted to said crossmember, said first strut affixed to one of said pair of clamshell-type gates; and a second strut pivotally mounted to said crossmember, said second strut affixed to another of said pair of clamshell-type gates, said crossmember comprising:

a first bridging bar affixed to one of said side hopper walls; and a second bridging bar parallel to and aligned with said first bridging bar, said second bridging bar affixed to each of said side hopper walls, said first and second struts pivotally mounted between said first bridging bar and said second bridging bar;

a first cross pin extending between said first bridging bar and said second bridging bar, said first cross pin receiving said first strut; and a second cross pin extending between said first bridging bar and said second bridging bar, said second cross pin receiving said second strut.

* * * * *